United States Patent [19]

Rich

[11] Patent Number: 4,747,579

[45] Date of Patent: May 31, 1988

[54] POST FRAME MACHINE

[76] Inventor: John W. Rich, P.O. Box 810, Elburn, Ill. 60119

[21] Appl. No.: 28,899

[22] Filed: Mar. 23, 1987

[51] Int. Cl.[4] ..... B21D 1/00; B66F 5/04

[52] U.S. Cl. ..... 254/386; 72/705; 254/264; 254/391

[58] Field of Search ..... 254/386, 391, 264; 72/447, 705

[56] References Cited

U.S. PATENT DOCUMENTS

| | | | |
|---|---|---|---|
| 3,566,667 | 3/1971 | Hagerty | 72/705 X |
| 3,589,680 | 6/1971 | Kuhn | 72/705 X |
| 3,612,482 | 10/1971 | Eck | 254/264 X |
| 3,754,432 | 8/1973 | Hagerty | 72/705 X |
| 3,835,692 | 9/1974 | Hoffman | 72/705 X |
| 3,955,397 | 5/1976 | Meis | 72/705 X |
| 4,455,859 | 6/1984 | Yamada | 72/705 X |
| 4,475,716 | 10/1984 | Jarmin | 72/705 X |
| 4,530,232 | 7/1985 | Smith | 72/705 X |
| 4,546,638 | 10/1985 | Field | 72/705 X |
| 4,574,613 | 3/1986 | Doughty | 72/705 X |

*Primary Examiner*—Stuart S. Levy
*Assistant Examiner*—Katherine Matecki
*Attorney, Agent, or Firm*—Robert E. Knechtel; Basil E. Demeur

[57] ABSTRACT

A post frame machine for applying pulling forces to a damaged automobile comprises two vertical support posts fixedly mounted on a base frame, a hydraulically operated cylinder disposed in each of the posts, and a load chain and pulley arrangement for exerting the pulling force. The cylinders are independently operable to allow different forces to be applied at closely adjacent location on the automobile. The apparatus further includes chain locks for securing the load chains.

3 Claims, 2 Drawing Sheets

FIG. 1
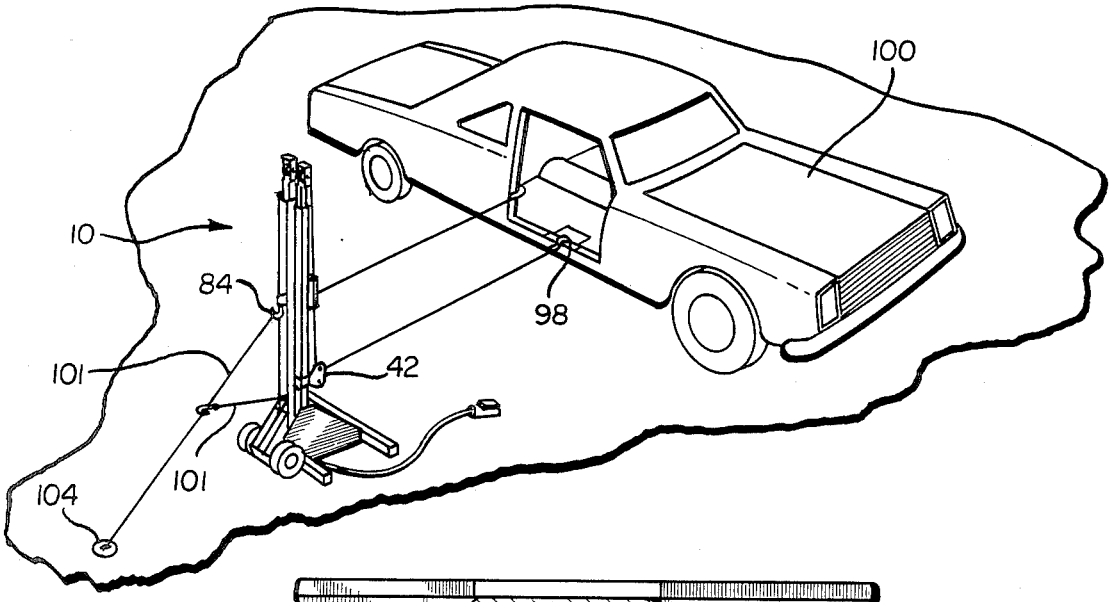
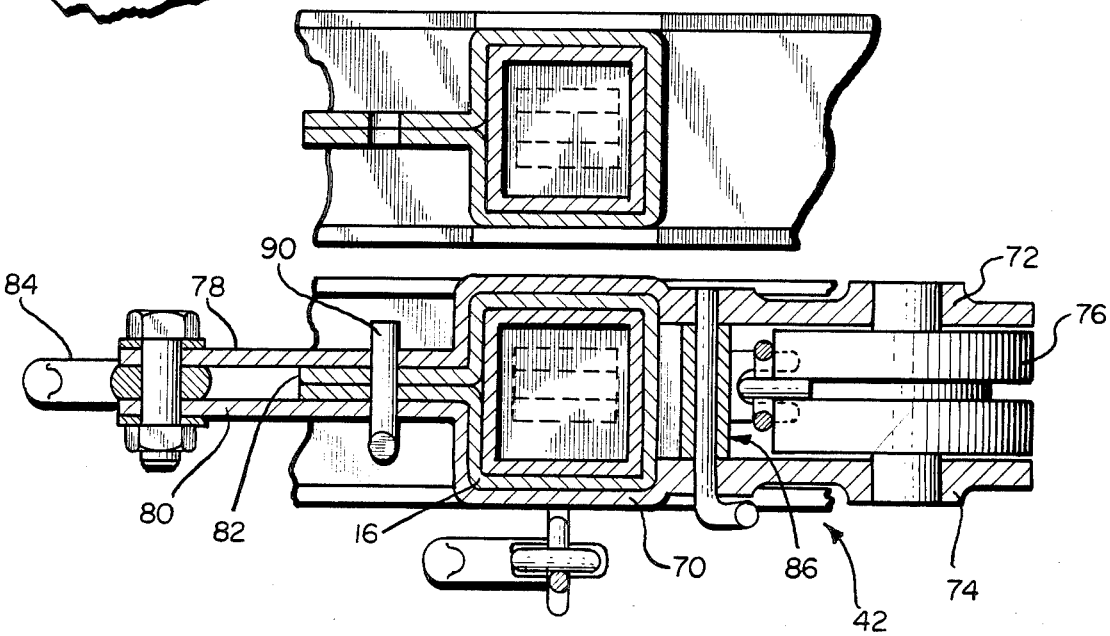
FIG. 4

POST FRAME MACHINE

BACKGROUND OF THE INVENTION

This invention relates to a post frame machine for applying a pulling force to a workpiece such as a portion of a damaged automobile to be restored to an original configuration. More particularly, it relates to such a post frame machine which can be used to apply not only a pulling force to such a workpiece, but can be used to apply two independent pulling forces which may be the same or different to such a workpiece. More particularly still, these two pulling forces can be applied to two closely spaced-apart portions of the workpiece.

Post frame machines are generally known in the prior art and are used extensively in the autobody business to repair damaged automobile bodies. For example, prior post frame machines are shown in U.S. Pats. Nos. 3,566,667; 3,589,680; 3,612,482 and 3,754,432. None of these prior post frame machines have the capability of applying simultaneously dual pulling forces to a workpiece. In the past, whenever it was desired to apply two pulling forces simultaneously to a workpiece, it was necessary to utilize two such post frame machines. Using two post frame machines, however, is sometimes difficult to do since the machines are bulky and awkward to use. Also, both machines must be tied down. if the pulling forces are to applied to two closely spaced-apart portions of a workpiece, the difficulties are compounded because of the bulkiness and awkwardness of the post frame machines and the need to anchor them down. The post frame machine of the present invention overcomes the difficulties of both applying simultaneously dual pulling forrces to a workpiece, and particularly when the dual pulling forces are to be applied to two closely spaced-apart portions of a workpiece.

Another disadvantage and safety hazard associated with the prior post frame machines is that the load chain which applies the pulling force to the workpiece is sometimes released from tension and is inadvertently released such that it snakes or whips. In doing so, a worker may be struck and injured by the load chain. With the post frame machine of the present invention, this safety hazard is virtually eliminated.

The post frame machine of the present invention generally is formed of two vertical support posts which are fixedly mounted with a base frame in closely spaced relationshp and which include therein respectively a telescopically movable power post having a chain sprocket on the upper end thereof for applying a pulling force to a load chain as the power post is extended. A fulcrum pulley is carred by each of the support posts and can be vertically adjusted and positioned along the length of the support post. The support posts are spaced apart sufficiently to permit the fulcrum pulleys to be independently vertically adjusted without interfering with one another. The power posts are extended and retracted by hydraulic cylinders which are disposed at the lower ends of the support posts and coupled to the lower ends of the power posts. The load chains which apply the pulling force to a workpiece extend about sprocket wheels carried by the fulcrum pulleys and about the sprocket wheels carried by the power posts, and the free ends thereof are secured locked into position by chain locks affixed to the support posts. The fulcrum pulleys also include chain locks for locking the load chains under tension when the power posts are retracted so that the free ends of the load chains are prevented from snaking or whipping.

The above described, as well as other, improvements and advantages of the post frame machine of the invention will become apparent from the following description when considered in conjunction with the accompanying drawings.

BRIEF DESCRIPTION OF THE DRAWINGS

FIG. 1 is a perspective view generally illustrating the manner in which the post frame machine is utilized.

FIG. 4 is a sectional view taken generally along lines 4—4 of FIG. 2.

DESCRIPTION OF THE PREFERRED EMBODIMENT

Figure 2:
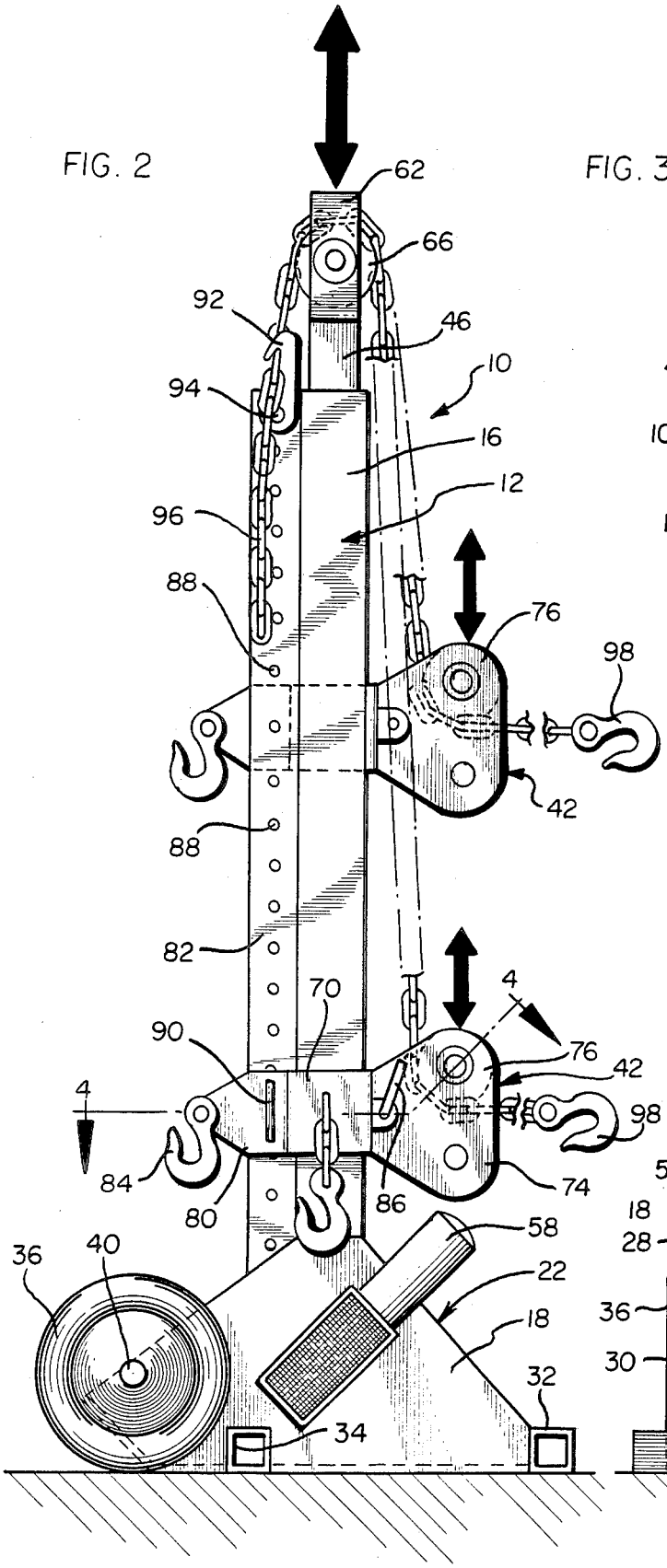
FIG. 2 is a side plan view of the post frame machine.

Referring now to the drawings, there is disclosed a post frame machine 10 which, as can be best seen in FIGS. 2 and 3, includes two post frame assemblies 12, 14 which are of an identical construction and operation, and which are fixedly secured together at the bases thereof, as more particularly described below. Each of the post frame assemblies 12, 14 has a vertically disposed, rectangular-shaped tubular support post 16 which, at its lower end, is fixedly secured between the generally triangular-shaped side plates 18, 20 of a U-shaped base support 22. The base supports 22 of the two post frame assemblies 12, 14 are fixedly secured together, as by welds 28, 30 and further have tubular base stabilizer bars 32, 34 fixedly secured across the front and the rear of them so as to provide a strong, stable base support for the post frame machine 10. A pair of wheels 36, 38 are affixed to an axle 40 supported by the base supports 22 for transporting the post frame machine 10, by tilting the latter onto the wheels 36, 38.

A fulcrum pulley 42 is adjustably supported by the respective ones of the support posts 16, and the base supports 22 and the support posts 16 are closely spaced together and only spaced far enough apart to provide clearance so that these fulcrum pulleys 42 can be vertically adjusted up and down the support posts 16 without interfering with one another. By constructing the post frame machine 10 in this fashion, simultaneous dual pulling forces can be applied to two closely spaced-apart portions of a damaged automobile, as more fully described below.

A tubular power post 46 is telescopically disposed within the respective ones of the support posts 16, and the lower ends thereof are affixed to the pistons 54 of a pair of hydraulically operated cylinder 50 which are disposed between the side plates 18, 20 of the base supports 22 and which extend into the support posts 16. The hydraulic cylinders 50 serve as the source of the desired pulling force, by extending the power posts 46, as more fully described below. Any of the conventional sources of hydraulic power may be employed to power the hydraulic cylinders 50 to extend their pistons 54, and each of them has a foot pedal operated fluid control valve 58 of the type well known in the art for controlling the supply of hydraulic power to them. A box yoke 62 is affixed to the top of the power posts 46, respectively, and has rotatably secured within them sprocket wheels 66.

Figure 3:
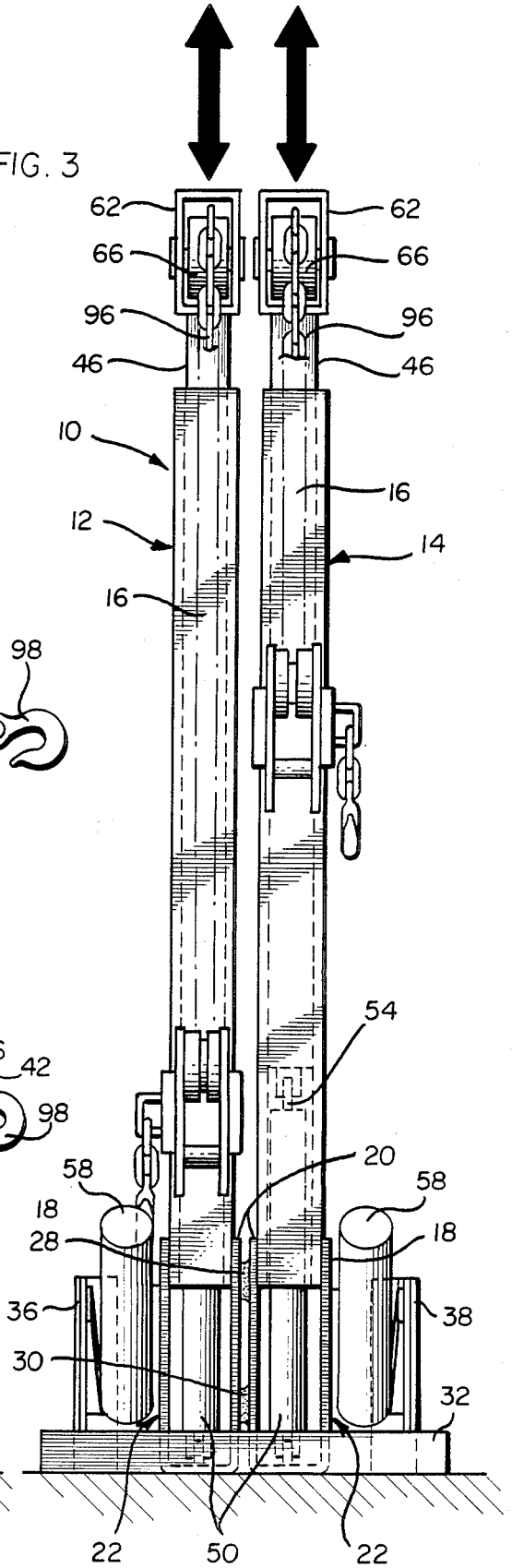
FIG. 3 is a front plan view of the post frame machine.

The fulcrum pulleys 42, as can be best seen in FIGS. 2 and 4, have a bracket portion 70 shaped and sized to fit about the support posts 16, and on one side thereof a pair of arms 72, 74 forming a yoke for supporting therebetween a sprocket wheel 76. On the other side of the bracket portion 70 there are two other arms 78, 80 which are spaced-apart so as to receive therebetween a bar 82 which is affixed to the support post 16 and which have a hook 84 secured to the ends thereof. In the illustrated embodiment, as can be best seen in FIG. 4, the support posts 16 are formed by bending sheet material into a box-shape to form a post having an extended pair of arms which form the bar 82. A chain lock 86 also is affixed between the arms 72, 74 and is pivotal so as to engage and to lock a chain extended around the sprocket wheel 76 in a fixed position, as more fully described below. The bar 82 has holes 88 formed in it in spaced-apart relationship along its length for receiving therethrough a pin 90 carried by the arms 78, 80 for vertically adjusting the position of fulcrum pulleys 74. A chain lock 92 also is secured to the bar 82 at its upper end by means of a pin 94 extended through it and a hole 88 in the bar 82 such that the chain lock 92 can be pivotally operated to engage a chain to lock it in place.

A load chain 96 extends around the top f the sprocket wheel 66 and around the bottom of the sprocket wheel 76, and its one end is locked into position by the chain lock 92.

Having now described the construction of the post frame machine 10, its operation can be described as follows in simultaneously applying dual pulling forces to two closely spaced-apart portions of a workpiece, such as a damaged automobile. As indicated above, in the past, normally two post frame machines had to be anchored adjacent the workpiece. If the damaged portions of the workpiece which are to be repaired were close together, this is normally quite difficult because the post frame machines are quite bulky and awkward to use. In the case of the post frame machine 10, however, it is simply anchored adjacent the workpiece, in the illustrated example, a damaged automobile 100, in the conventional fashion, by means of chains 101 or the like which are affixed to an anchor 104 and to one or both hooks 84 secured to the fulcrum pulleys 42, as illustrated in FIG. 1.

Once anchored, one of the load chains 96 is affixed to the damaged portion of the automobile in one location where it is desired to apply a pulling foce, by means of the hook 98 on its end, or in any other suitable fashion. The load chain 96 then is extended beneath and around the sprocket wheel 76 fo the fulcrum pulley 42, on the support post 16, and over the top of the sprocket wheel 66 affixed to the top of the power post 46 telescopically disposed within it. At this time, the power post 46 preferably should be fully retracted into the support post 16. The load chain 96 is pulled taut and is locked into position by pivotally operating the chain lock 92 to engage it about one of the chain's links. Next, the other load chain 96 is affixed in the same fashion to the other location of the damaged automobile where it is desired to apply simultaneously another pulling force. It may be noted that the two locations can be relatively close together because of the construction of the post frame machine 10, with the two support posts 16 being closely spaced together. The load chain 96 is then disposed about the sprocket wheels 76 and 66 carried by the other one of the two power posts 46, and locked in place in the manner described above.

A pulling force is applied to the load chains 96, by operating the control valves 58 which action, in turn, operates the hydraulic cylinders 50 to extend (or retract) their pistons 54. When the pistons 54 are extended, the telescoping power posts 46 are raised, thus retracting the load chains 96 to develop the desired pulling force. The hydraulic cylinders 50 can be operated independently to apply different pulling forces, as desired, to each of the two damaged portions of the automobile.

As described above, in many cases in applying a pulling force, the piston of a hydraulic cylinder may be fully extended and, in order to apply any additional pulling force, the pulling force must be relieved and the load chain re-adjusted and locked into a different position. Normally this is accomplished by retracting the pistons of the hydraulic cylinders and, hence, the posts 46 into the support posts 16. Doing so can create a hazardous situation unless extreme care is exercised since there may be a considerable pulling force being applied by the load chain to the damaged portion of the automobile. When this pulling force is relieved, the load chain may no longer be retained under tension and may inadvertently release from the chain lock which secures it. If the load chain is released, it may whip or snap and strike a worker.

With the post frame machine 10 this safety hazard is virtually eliminated. If an additional pulling force is required, the load chain 96 is retained under tension, and the chain lock 86 carried by the fulcrum pulley 42 is pivotally operated to lockingly engage it with a link of the load chain, against the sprocket wheel 76. Now, when the hydraulic cylinder 50 is operated to retract its piston 56 and, hence, the power post 46 into the support post 12, the load chain 96 is securely locked and retained under the tension of the pulling force already applied to the damaged portion of the automobile by the chain lock 86. The free end of the load chain 96 which normally is securely locked by the chain lock 92 therefore can be released without danger of the load chain 96 snaking or whipping since the load chain is locked under tension by the chain lock 86. The power post 46 can be rtetracted into the support post 16 to any desired extent, the load chain 96 again relocked by the chain lock 92, and the hydraulic cylinder 50 again operated to extend the power post 46 to re-apply the additional pulling force to the load chain 96. As the additional pulling force is applied and the load chain 96 is pulled around the sprocket wheel 76, the chain lock 86 automatically releases the load chain 96.

What is claimed is:

1. A post frame machine for applying simultaneously two pulling forces to a workpiece in two closely spaced-apart locations on said workpiece comprising:

a base having affixed thereto a pair of wheels for transporting said post frame machine;

a pair of support posts fixedly secured to said base and vertically mounted in closely spaced-apart relationship, each of said support posts having a power post telescopically disposed therein;

a first chain sprocket wheel fixedly and rotatably secured atop each of said power posts;

a fulcrum pulley secured to each of said support posts and selectively positionable along the vertical length thereof, each of said fulcrum pulleys including a second chain sprocket wheel;

a load chain associated with each of said support and power posts extendable from a workpiece beneath and around said second chain sprocket wheel and over and around said first sprocket wheel;

a first chain lock secured to each of said support posts and operable to engage a free end of said load chains to secure said load chains;

a hydraulically operated cylinder having a piston vertically disposed within each of said support posts, said pistons being coupled with said power posts whereby upon actuation of said cylinders said pistons are operable to extend said power posts to develop a pulling force on said load chains, said cylinders being operable independently of one another whereby the same or different pulling forces can be applied simultaneously to a workpiece to two closely spaced locations of the workpiece.

2. The post frame machine of claim 1, further including in each of said fulcrum pulleys a second chain lock operatively associated with said second chain sprocket wheel, said second chain locks being operable to engage with a load chain, whereby said load chain while applying a pulling force to a workpiece can be locked under the tension of said pulling force and said power post can be retracted into said support post, thereby permitting an additional pulling force to be applied to the workpiece by simply releasing and re-securing the free end of said load chain with said second chain lock and again extending said power post.

3. The post frame machine of claim 1, wherein each of said support posts has a bar which projects perpendicularly from it and which extends along the vertical length thereof, a plurality of holes in said bar in spaced-apart relationship along the vertical length thereof, each of said fulcrum pulleys having a pair of arms for receiving therebetween said bars on said support posts and holes in said arms for receiving a pin, whereby said fulcrum pulleys can be selectively positioned along the vertical length of said support posts by extending a pin through said holes in said arms and said holes in said bars.

* * * * *